US011052282B2

(12) United States Patent
Brask

(10) Patent No.: US 11,052,282 B2
(45) Date of Patent: Jul. 6, 2021

(54) NECKBALANCE

(71) Applicant: FREBRA HOLDING AS, Rolvsøy (NO)

(72) Inventor: Bent Brask, Rolvsøy (NO)

(73) Assignee: FREBRA HOLDING AS, Rolvsøy (NO)

( * ) Notice: Subject to any disclaimer, the term of this patent is extended or adjusted under 35 U.S.C. 154(b) by 0 days.

(21) Appl. No.: 16/344,250

(22) PCT Filed: Oct. 27, 2017

(86) PCT No.: PCT/NO2017/050276
§ 371 (c)(1),
(2) Date: Apr. 23, 2019

(87) PCT Pub. No.: WO2018/080320
PCT Pub. Date: May 3, 2018

(65) Prior Publication Data

US 2019/0247711 A1 Aug. 15, 2019

(30) Foreign Application Priority Data

Oct. 27, 2016 (NO) ..... 20161703

(51) Int. Cl.
*A63B 23/025* (2006.01)
*A63B 71/10* (2006.01)
(Continued)

(52) U.S. Cl.
CPC ..... *A63B 23/025* (2013.01); *A63B 21/0004* (2013.01); *A63B 21/0023* (2013.01);
(Continued)

(58) Field of Classification Search
CPC ..... A63B 23/025; A63B 21/00185; A63B 21/0608; A63B 21/0601; A63B 21/027;
(Continued)

(56) References Cited

U.S. PATENT DOCUMENTS 2,051,366 A 8/1936 Catron
2,855,202 A 10/1958 Kinne
(Continued)

FOREIGN PATENT DOCUMENTS

DE 20 2013 006 531 U1 10/2013
FR 3 005 582 A1 11/2014

OTHER PUBLICATIONS

Written Opinion (PCT/ISA/237) issued in PCT/WO2017/050276, dated Mar. 19, 2018.
(Continued)

*Primary Examiner* — Megan Anderson
*Assistant Examiner* — Kathleen Vermillera
(74) *Attorney, Agent, or Firm* — Birch, Stewart, Kolasch & Birch, LLP

(57) ABSTRACT

A device and method for influencing the movement and muscular function in the neck, includes a helmet, the helmet has a rim, said rim has notches along the edge, on top of the helmet there is attached a vertical rod, on top of this vertical rod there is attached at least two laser sights pointing forward, at least one rod is attached at one end to the vertical rod, and the at least one rod can rotate around the vertical rod.

9 Claims, 3 Drawing Sheets

(51) Int. Cl.

| | |
|---|---|
| ***A63B 21/00*** | (2006.01) |
| ***A63B 21/002*** | (2006.01) |
| ***A63B 21/065*** | (2006.01) |
| ***A63B 21/06*** | (2006.01) |
| ***A63B 26/00*** | (2006.01) |
| ***A63B 71/06*** | (2006.01) |

(52) U.S. Cl.
CPC .. *A63B 21/00072* (2013.01); *A63B 21/00178* (2013.01); *A63B 21/06* (2013.01); *A63B 21/065* (2013.01); *A63B 21/0608* (2013.01); *A63B 21/4003* (2015.10); *A63B 21/4025* (2015.10); *A63B 26/003* (2013.01); *A63B 71/10* (2013.01); *A63B 2071/0694* (2013.01); *A63B 2208/0233* (2013.01)

(58) Field of Classification Search
CPC ..... A63B 21/00178; A63B 21/00061; A63B 21/00047; A63B 21/06; A63B 21/00072; A63B 21/0004; A63B 21/0023; A63B 21/065; A63B 21/4003; A63B 21/4025; A63B 21/00069; A63B 21/00043; A63B 26/003; A63B 71/10; A63B 2208/0204; A63B 2208/0233; A63B 2071/0694; A63B 2071/0652; A63B 2071/0658; A63B 2071/0661; A63B 2071/0666; A63B 2069/3629; A61H 1/0296; A61H 2201/165; A61H 2201/1602; A61B 5/6803; A42B 3/0406; G09B 19/003; G09B 19/0038
USPC ..... 446/26, 27; 273/DIG. 17; 473/208–211, 473/274
See application file for complete search history.

(56) References Cited

U.S. PATENT DOCUMENTS

| | | | | |
|---|---|---|---|---|
| 4,186,429 | A * | 1/1980 | Johnston | A42B 3/044 362/106 |
| 4,813,680 | A * | 3/1989 | Rudell | A63F 9/00 273/138.1 |
| 5,090,708 | A * | 2/1992 | Gerlitz | A63F 9/0291 273/DIG. 17 |
| 5,116,359 | A | 5/1992 | Moore | |
| 5,996,127 | A * | 12/1999 | Leslie | A01K 39/012 119/715 |
| 6,000,066 | A | 12/1999 | Williams | |
| 6,106,437 | A | 8/2000 | Brooks | |
| 9,211,438 | B2 * | 12/2015 | Versteegh | A63B 21/00065 |
| 9,498,675 | B2 * | 11/2016 | Walworth | A63B 23/025 |
| 2010/0292051 | A1 | 11/2010 | Benumof et al. | |
| 2016/0101011 | A1 * | 4/2016 | Swenson | A61H 1/0296 482/10 |
| 2016/0213973 | A1 | 7/2016 | Walworth | |

OTHER PUBLICATIONS

International Search Report (PCT/ISA/210) issued in PCT/NO2017/050276, dated Mar. 19, 2018.
Search Report issued in Norwegian Patent Application No. 20161703, dated Mar. 23, 2017.
Written Opinion (PCT/ISA/237) issued in PCT/NO2017/050276, dated Mar. 19, 2018.

* cited by examiner

NECKBALANCE

TECHNICAL FIELD

The present invention regards a device and a method for influencing the movement and muscular function in the neck of a person, and more particularly a device and method for influencing the neck muscular function in stability, endurance, strength, fine motor control and gross motor control.

BACKGROUND OF THE INVENTION

The head is the body part with the highest density. It harbors and uses more of the blood's volume and resources than what the space would indicate. For the head to balance properly, the neck has to function properly.

For stability when balancing the head, the muscular function has to be adequate to keep the head in an upright-position over the neck and to create muscular control for movement. To keep an upright position and to keep it over time is foundationally the work of the deep core muscles. These muscles are not strong, but have great endurance.

The outer global muscles are strong, but do not have great endurance. These muscles are important in functions that create larger forces such as forcing the head upwards when lifting or moving the head rapidly e.g. when looking at something that happened suddenly.

The head, with its many sensory organs (eyes, ears, nose, mouth and skin) and communication functions, needs a fine-tuned motor system for positioning of these sensory and communicative organs. This is done by coordination of the larger global surface muscles and the deep fine motor musculature.

The motor system of the neck is driven by willful wishes for movement. It is also driven by an intricate system of reflexes that coordinate the neck function with different sensory organs. In this system the muscular health, from the biochemical status to the muscular force generation, is of utmost importance.

US 2010292051 A1 is an example of exercise equipment made for whiplash recovery. The equipment is a portable neck exercise apparatus. The apparatus is meant to be carried on your back. A headband connects the users head to the apparatus. The headband is connected to a set of wires and an adjustable mechanism makes it possible to adjust the tension on the neck. The user exercises the neck by moving the head back and forth.

There are several problems and drawbacks with this solution; one problem is that the apparatus needs to be carried on the back. It is a large, heavy and bulky apparatus that can only be used while the user is standing. A further problem is that it is only possible to exercise the neck by tilting the head back and forth. This results in that the neck can only be exercised in one direction. Yet another problem is that the apparatus uses restraints to exercise the neck. This increases the danger of exercise related injuries.

FR 3005582 A1 describes an apparatus intended to help with the treatment of neck related injuries. Also this device is meant to be carried on the back of the user. In this device the back of the head rests on a support. The neck is exercised by pushing the head against the support.

The problem with this solution is much the same as with US 2010292051 A1. The device can only be used while the user is standing. It is large, heavy and bulky, it only exercises the neck in one direction and it uses a restraining motion on the neck, increasing the dangers of injuries.

SUMMARY OF THE INVENTION

It is therefore the object of the present invention, as it is stated in the set of claims, to solve the problems mentioned above.

The present invention comprises a helmet, said helmet has a rim, and said rim has notches along the top edge. On top of the helmet there is attached a vertical rod. On top of this vertical rod there is attached at least one laser pointing forward. To the base of the vertical rod there is attached at least a second rod. Said at least one second rod can rotate around the vertical rod. Said helmet has a chin strap.

The apparatus can be used for fine motor training by moving the head, in conjunction with the laser part of the apparatus. It will also train mobility and strength by movement of the head in different directions and patterns (e.g. simple one direction movement to complex hula hoop movements). It can also do these movements with focused weight loads at specific angles. The level of difficulty can be changed by the size of a weight loads and the position of the weight loads along the at least one second rod.

The apparatus is an apparatus that is designed to create good motor function in the movements in all of the joints of the neck.

The circular rim of the helmet has notches along the top edge. These notches are spaced evenly around the top edge of the rim. The distance between the notches can vary from device to device depending on the desired level of fine tuning. There can be either one or more rods attached to the base of the vertical rod, and all of them should be able to move freely around the vertical rod. The freely moving rods rest in the notches along the top edge of the rim around the helmet. Slidable weights can be added to the freely mowing rods.

On top of the vertical rod there is at least one laser. If there is more than one laser they are all spread out in a fan like formation with all the lasers pointing forwards. The distance between the lasers can vary from device to device and they can either be at set angles to each other, or the angles can be adjusted.

DETAILED DESCRIPTION

Figure 1:
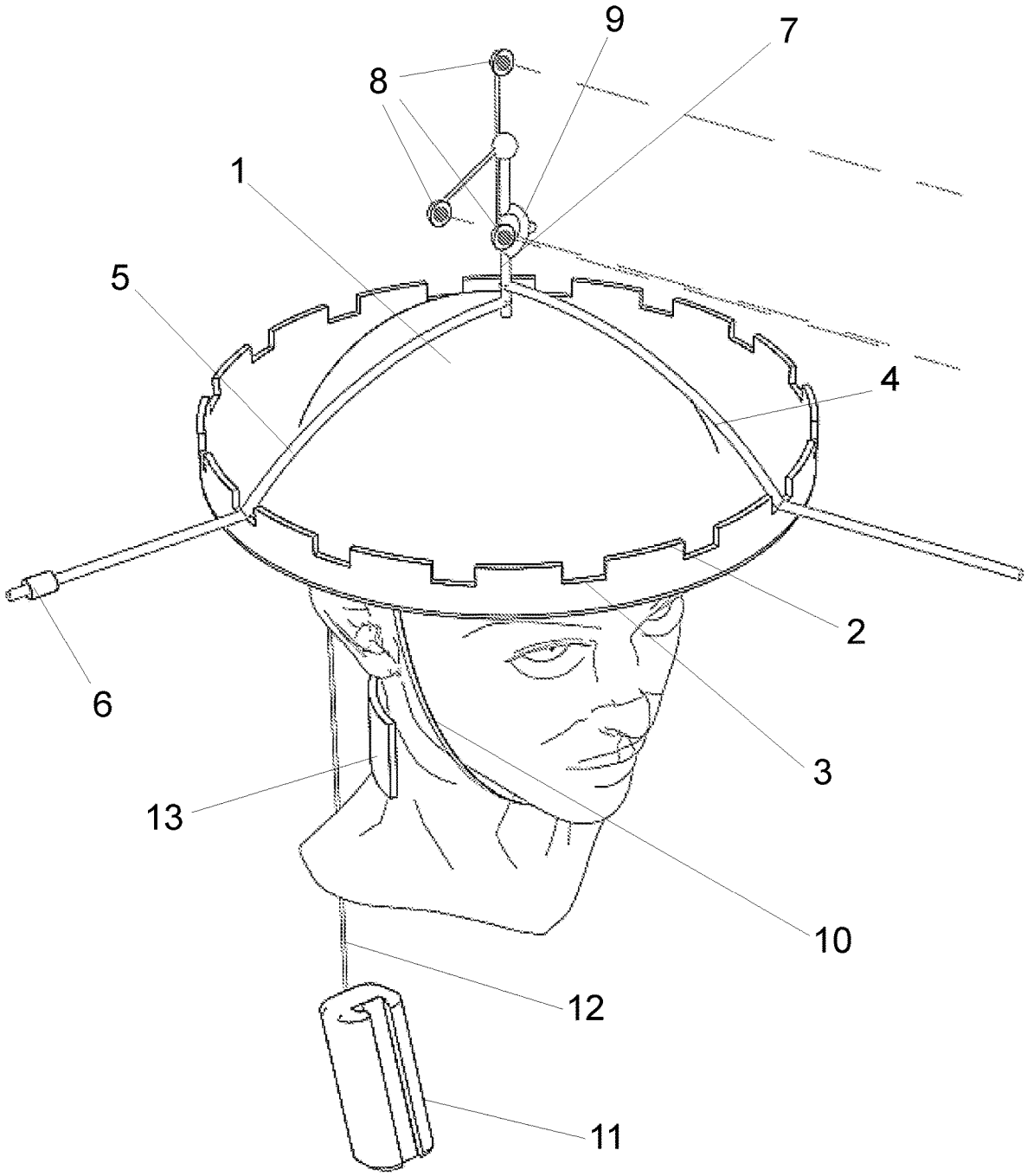
FIG. 1 is a perspective view of an embodiment of the present invention showing a helmet attached to the head of a user.

FIG. 1 is a perspective view of an embodiment of the present invention showing a helmet attached to the head of a user. The helmet comprises a dome 1. Attached to the bottom part of the dome there is a rim 2. This rim has an upright edge. This upright edge has notches 3 spaced out evenly all the way around. In an embodiment of the present invention there are approximately 20 degrees between each notch. This can however be any set interval of degrees between 1° and 90°. A preferred set of intervals can be 20°, 22.5° or 45°.

To the top of the helmet there is attached a vertical rod 7. To this vertical rod there is attached at least one more rods 4, 5. This at least one more rod are attached to the base of the vertical rod. The at least one more rod rotate freely around the vertical rod. The at least one more rod can rest in the notches on the top edge of the rim.

The at least one more rod follow the curvature of the dome from the base of the vertical rod to the top edge of the rim. At the rim the at least one more rod has an elongated horizontal part. The at least one more rod can rotate freely around the vertical rod. The at least one more rod can rest in the notches of the top edge of the rim. A weight 6 can be attached to the at least one more rod. The weights can move along the horizontal part of the at least one more rod and can be fixed at any distance from the end of the at least one more rod. Further these weights can have different loads.

The at least one more rod with weights attached can be have any weight attached that can be placed at any distance from the end of the horizontal part of the at least on more rod. This enables weight loading at specific angles and training for stability and strength at positions/angles that are defined in detail. It will also enable functional training in a specific direction with weight loads at specific angles. By adding weights at the ipsilateral and contralateral side of a defined area to be trained, the exercises can be concentric or eccentric.

In this embodiment there are attached three lasers 8 to the top of the vertical rod. Each of the three lasers is placed in a fan like formation. Each of the lasers is placed at the end of a rod. The rod is attached to a central hub. The central hub is attached to the end of the vertical rod. This fan like formation can be rotated around the central hub with the lasers always pointing forwards.

The fan like formation comprising the three small rods has 60, 120 and 180 degrees between them. The ends of the rods have a rounded material spring-loaded space for the lasers to be fastened in. The device can be rotated. The lasers can rotate in a circular motion always facing forward. In this way two lasers can be vertical or horizontal. The laser attachment is used with one laser active at the top, two vertically or two horizontally. In the vertical rod there is a notch 9 where the lower vertical laser will have its place in the vertical stance.

The lasers give visual clues that define the movement of the head. They give the necessary cue for movement defined by lines, and stability defined by bullseyes. The two lasers in vertical and horizontal direction gives the user two points of reference in his exercise. This secures the exercises to be done with the head in a true upright position and not with any kind of head tilting.

In the embodiment presented here there are illustrated three lasers, but any number of lasers can be used.

A circular tube can be fastened (laid on) to the rim of the helmet. In the tube there is a movable weight that moves with the movement of the head. The material can for example be metal balls or liquids. The tube can be detached. It can have different radii.

As the head is moved outside a perfect horizontal position the weight in the tube will move towards the lowest point and more of the weight will gather here. This will create an eccentric muscular load (the weight has to be stopped) followed by a concentric contraction to straighten the head with the ring again. This creates an accentuated dynamic model of normal head function. The apparatus can be used for fine motor training by moving the base support, the body, in conjunction with the laser part of the apparatus. It will also train mobility and strength by movement of the head in different directions and patterns (e.g. hula hoop movements). The level of difficulty can be changed by the size of the ring or the weight of the movable mass.

Further the device comprises a neck support. This neck support comprises three parts. A support rod 12 fastened to e.g. a chair back. On this support rod there is fastened a horizontal rod 11 that can be moved up and down the support rod. Further it can extend its length from the vertical rod. At the end there is fastened a half circular element 13 that can support the neck. The sides of the half circles can be moved in and out for support of different size necks. It can be positioned up and down and at the right distance through the vertical and horizontal rods. It can also move in an up and down movement at its attachment to the horizontal rod.

The neck support gives support to the neck and it defines the movement axis by where the upper border touches the neck.

A software program for recording measurements and presenting them in a numeric and visual fashion for the user, therapist and patient is also included. It will also present the persons progress after a time of exercise.

Figure 2:
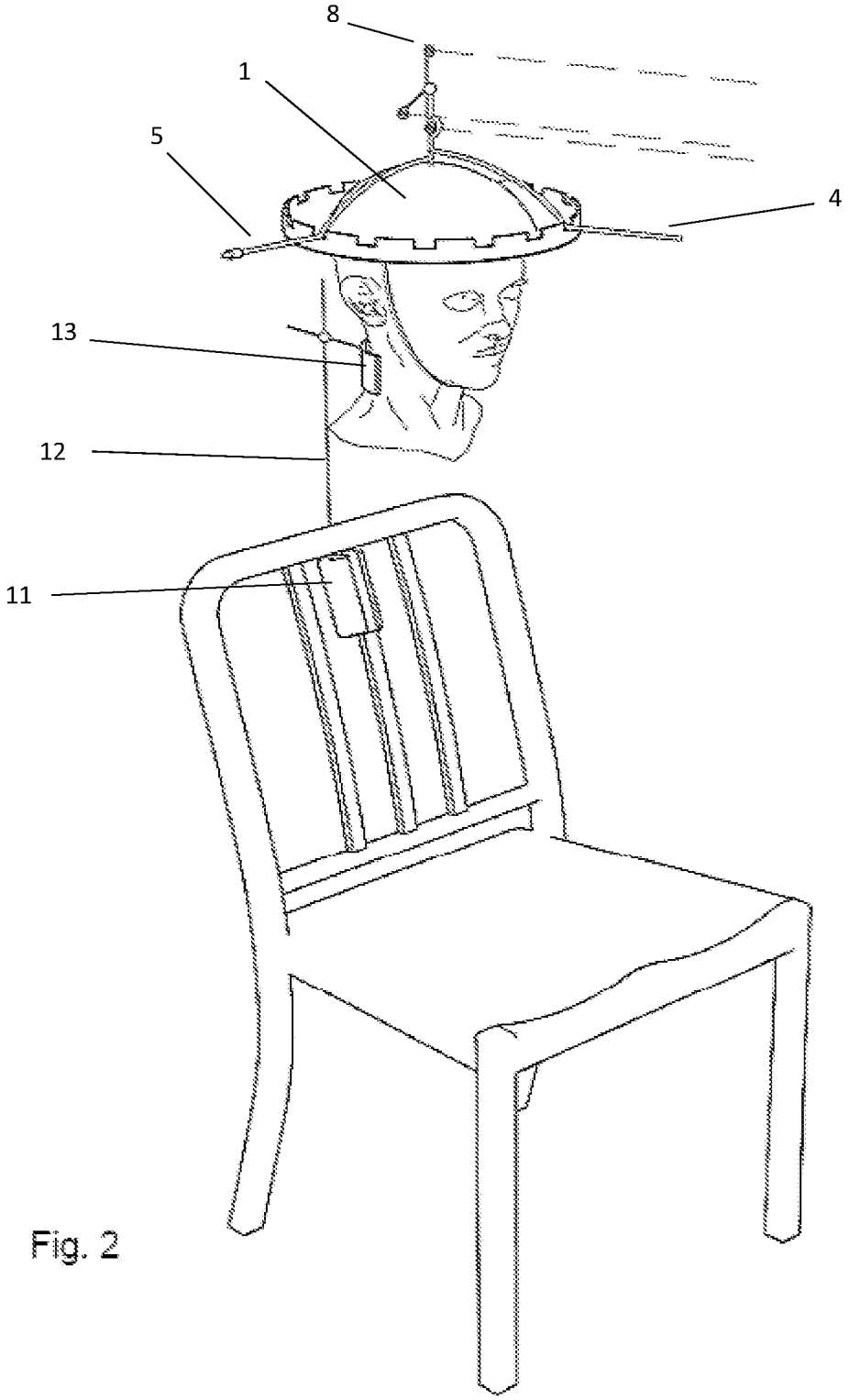
FIG. 2 is a perspective view showing the embodiment presented in FIG. 1 used on a person sitting in a chair.

FIG. 2 is a perspective view showing the embodiment presented in FIG. 1 how it is used on a person sitting in a chair.

In this solution the user is seated in a chair. To the back of the chair there is attached a neck support. The neck support can be adjusted to fit the user. On top of the head of the user there is placed a helmet. The helmet is secured to the users head with a chin strap. On top of the helmet there is attached a vertical rod. At the top of this vertical rod there are attached three lasers. Each laser is attached at the end of a small rod. Each of the rods is set in a fixed angle to each other. These angles are preferably 60°, 120° and 180°. These smaller rods can rotate around a central hub attached to the top of the vertical rod always facing forwards.

To the vertical rod there are attached a second and a third rod. These second and third rods have a curved inner part and a horizontal outer part. These second and third rods can rotate around the vertical rod. These second and third rods rest in the notches in the rim of the helmet.

To one of the second and third rods there is attached a weight. These weights can move along the outer horizontal part of the second and third rods.

Figure 3C:
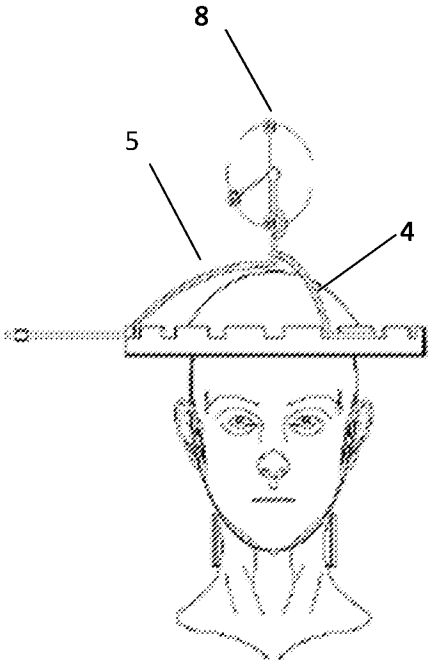
FIG. 3A-3C is a front view of the embodiment presented in FIG. 1 with the lasers at different positions.
Figure 3B:
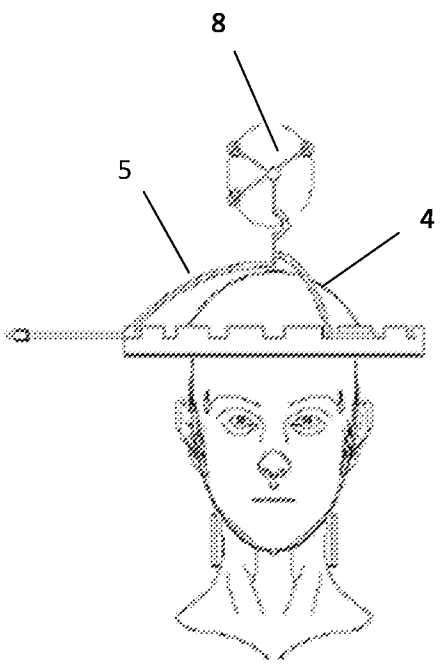
Figure 3A:
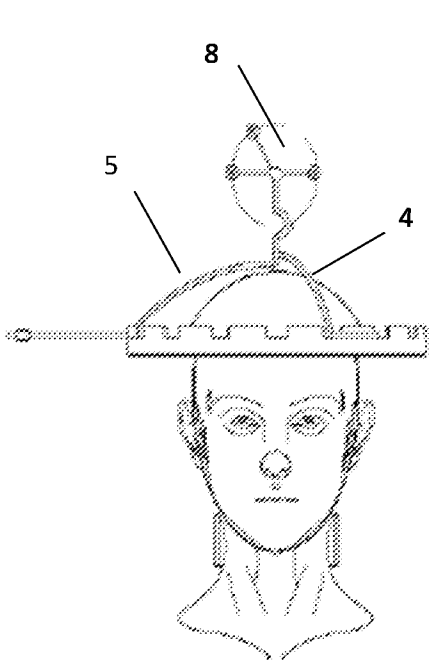

FIG. 3A-3C is a front view of the embodiment presented in FIG. 1 with the lasers at different positions.

The lasers are aimed at posters with different patterns and bullseye circles. The posters can be for assisting the user to move the head in a certain pattern, exercising fine-motor training.

An example of use can be one laser following a set of lines.

Two lasers can be used for following horizontal lines at different levels or vertical lines. Two lasers necessitate the head being level.

The bullseye posters are used by one laser being focused on the bullseye while the supporting ground of the person is unstable like in a moving mechanical horse. The person can also do different exercises like standing on one leg.

The present invention can also be used with movable ground equipment like e.g. a mechanical horse.

A manual muscle tester can be used with the present invention in order to assess the strength and movement of the neck muscles. Further it can be used to keep track of the progress of the user.

The muscle strength tester (dynamometer) is used by measuring the person's muscle strength by pushing down, up or sideways on the weight rods. This enables the measurement of the person's neck strength at different angles and directions. As the lever is being pushed down with the dynamometer the parallel lasers are required to be kept level within predefined degrees of range (+−10 degrees). The power used at the level, where the patient is not able to hold the head tilt within the predefined level, is recorded. A computerized system for recording and reporting the measurements will be developed. This will synchronize the point where the head tilting breaks the set limit, with the power used at this point. A level measuring device will be used to determine the head position. The lasers give the person a reference for head position.

A further device for use with the present invention is a level measurement device. This is known technology that will be used to measure the head position and degrees of deviation from upright position.

The laser is being used to measure the person's ability for neck stability and endurance. As the person sits in an upright position the ability to hold the laser at a certain position over time is measured. A timer is synchronized with the laser being held in a predefined position (degree range, +−10 degrees) where the length of time is recorded. The levers are being used to create loads at different positions/degrees of the helmet. This will give an evaluation of stability and endurance of the neck in general and the same with emphasized loads at different positions.

A computer software system for recording and reporting the findings will let the therapist and the patient get a good overview of the problem, what needs to be done and progress. It will consider the numbers gathered from the Manual muscle tester, level measuring device and timer.

The software program can also evaluate fine motor control. The program can have a sensor system that evaluates the person's ability to keep the laser point within certain defined area or track.

The invention claimed is:

1. A device for influencing movement and muscular function of a user's neck, said device comprising:

a helmet, the helmet comprising a rim, said rim having a plurality of notches along a top edge thereof, a vertical rod attached on a top of the helmet, at least one laser pointing in a forward direction on a top of the vertical rod, and at least one rod attached at a base of the vertical rod, wherein the at least one rod is configured to rotate around the vertical rod and rest in said plurality of notches; and a chin strap.

2. The device as stated in claim 1, wherein the at least one laser comprises a plurality of lasers, and wherein the plurality of lasers are configured in a fixed angle relative to each other.

3. The device as stated in claim 2, wherein the plurality of lasers comprises three lasers, and wherein the fixed angles between the three lasers are 60°, 120° and 180°.

4. The device as stated in claim 2, wherein each of the plurality of lasers are respectively attached to a rod, each of the rods is attached to a central hub, said central hub is attached to the top of said vertical rod, and said central hub is configured to rotate in a circular motion.

5. The device as stated in claim 4, wherein the plurality of notches are separated from one another by a set interval of degrees.

6. The device as stated in claim 4, wherein the at least one rod has at least one weight attached to it.

7. The device as stated in claim 6, wherein said weight said at least one weight is configured to along the at least one rod.

8. The device as stated in claim 1, wherein the at least one rod comprises a plurality of rods and, wherein the plurality of rods are configured to move independently of each other.

9. A method for influencing movement and muscular function in a user's neck, said method comprising using a helmet, the helmet comprising:

a rim, said rim having a plurality of notches along an edge thereof, a vertical rod attached on top of the helmet, at least one laser pointing in a forward direction on top of the vertical rod, and at least one rod attached at one end to the vertical rod, wherein the at least one rod is configured to rotate around the vertical rod.

* * * * *